United States Patent [19]

Cutcher et al.

[11] Patent Number: 4,927,550

[45] Date of Patent: May 22, 1990

[54] CORROSION PREVENTIVE COMPOSITION

[75] Inventors: John A. Cutcher, Westmont; Gary M. Andrews, Chicago Ridge, both of Ill.

[73] Assignee: Castrol Industrial Inc., Chicago, Ill.

[21] Appl. No.: 302,478

[22] Filed: Jan. 27, 1989

[51] Int. Cl.[5] ..... C10M 137/02; C10M 129/40

[52] U.S. Cl. ..... 252/32.5; 252/49.3; 252/56 R; 72/42

[58] Field of Search ..... 72/42; 252/32.5, 49.3

[56] References Cited

U.S. PATENT DOCUMENTS

| | | | |
|---|---|---|---|
| 3,635,826 | 1/1972 | Hamilton | 252/79.4 |
| 3,836,467 | 9/1974 | Jones | 72/42 |
| 3,837,803 | 9/1974 | Carter et al. | 252/87 |
| 3,873,374 | 3/1975 | Kolts | 72/42 |
| 4,160,089 | 7/1979 | Bussi et al. | 252/49.3 |
| 4,178,260 | 12/1979 | Cook et al. | 72/42 |
| 4,402,838 | 9/1983 | Eguchi et al. | 72/42 |
| 4,454,050 | 6/1984 | Bertell | 252/49.3 |
| 4,493,780 | 1/1985 | Schwartz et al. | 252/32.5 |
| 4,631,139 | 12/1986 | Burton et al. | 72/42 |
| 4,707,286 | 11/1987 | Care | 252/75 |
| 4,759,861 | 7/1988 | Ogura et al. | 252/49.3 |

FOREIGN PATENT DOCUMENTS

| | | | |
|---|---|---|---|
| 180561 | 7/1986 | European Pat. Off. . | |
| 81397 | 7/1981 | Japan | 72/42 |

*Primary Examiner*—William R. Dixon, Jr.
*Assistant Examiner*—Ellen M. McAvoy
*Attorney, Agent, or Firm*—Neuman, Williams, Anderson & Olson

[57] ABSTRACT

The present invention is, in one form, an aqueous alkaline metalworking fluid composition in the form of a concentrate which includes a salt of orthophosphoric acid; a dibasicdioic acid in an amount of up to about 5.0% by weight of the concentrate; an essentially phosphonate-free chelating agent; and, a neutralizing base. The composition may also include a lubricating agent, a coupling agent, a passavating agent, a biocide, and a colorant.

58 Claims, No Drawings

CORROSION PREVENTIVE COMPOSITION

BACKGROUND OF THE INVENTION

1. Field Of The Invention

This invention relates to the prevention of corrosion of ferrous metals in contact with aqueous systems and the reduction of tool wear in metalworking operations.

2. Brief Description Of The Prior Art

Water has long been the coolant of choice in engines, water towers, metal removal operations and other heat generating environments. The obvious problem of corrosion in such systems had for many years been addressed by the use of nitrite salts and nitrite/amine combinations. However, once it became known that the nitrosamines which are formed in such systems pose a health hazard, their use in environments where human contact was involved became severely limited.

One suggested approach has been to employ semipermanent phosphate-metal coatings, the formation of which requires extensive treatment processes, in an effort to reduce corrosion. However, these coatings are ineffective when broken by any metal removal operations.

In metal removal operations, it has been proposed to attempt to both reduce tool wear and provide some measure of corrosion protection by the use of phosphate esters. These phosphate ester additives do not alone provide enough corrosion protection, nor are they as cost effective as nitrite and nitrite/amine systems when combined with other rust preventives such as amines and amine soaps.

Another suggested approach has been to utilize phosphonic acid chelating salts in an attempt to reduce corrosion. The problem which has arisen in the use of phosphonates in the metalworking environment is that they are extremely effective in removing surface deposits and suspending fines, and they therefore remove and suspend rust and corrosion from all metal surfaces which they contact and suspend the fines generated by the metal removal operations. The result is that metalworking fluids which incorporate phosphonates readily transform an initially clear fluid into a brown, nearly opaque suspension. This is not only aesthetically undesirable, but it also causes the reject rate to be quite high for finished parts, since the brown fluid residue which remains on the parts is mistaken for surface rust of the part itself.

Yet another approach has been to employ dibasicdioic acids as rust and corrosion inhibitors in the metalworking environment, but, at the concentration levels ordinarily employed (usually 7 to 10% by weight of a concentrate), they are extremely expensive relative to other materials. Moreover, at such high concentrations, dibasicdioic acids are known to form salts which may contain nitrosamines. Further, experience has shown them to be of relatively low effectiveness and occasionally in rather short supply.

Thus, none of these suggested alternatives appears to offer an entirely satisfactory corrosion prevention system, particularly in the metal removal environment, from a functional, environmental or economic standpoint.

SUMMARY OF THE INVENTION

The present invention provides a new rust and corrosion preventive composition which is nitrite free, but which provides equal or better corrosion prevention than nitrite-containing compositions at about the same cost.

The corrosion preventive composition of the invention is an aqueous alkaline solution which includes a salt of orthophosphoric acid, from about 0.5% up to about 5.0% of a dibasicdioic acid, an essentially phosphonate-free chelating agent, and a neutralizing base.

Inclusion in the composition of a rather small amount of dibasicdioic acid along with the orthophosphoric acid salt was found to produce a quite unexpectedly superior increase in rust protection performance. Heretofore, low levels of dibasicdioic acids were well known to be ineffective in providing the level of rust and corrosion prevention required in a typical metalworking environment. The inclusion of a rather small amount of dibasicdioic acid in the composition of the invention (on the order of about 1% by weight) was found not only to be quite effective in combination with the orthophosphoric acid salt, but to provide a much higher level of rust protection than that provided by significantly greater amounts dibasicdioic acid (7 to 10% by weight) in other systems.

Elimination of phosphonates from the composition was found to avoid the problems of discoloration of the fluid and the consequent rejection of finished parts due to the deposit of discolored fluid residues. In addition, phosphonates are known to react with polymeric quaternary ammonium biocides to form insoluble salts, and the elimination of phosphonates permits the use of polymeric quaternary ammonium materials as biocides in the composition of the invention.

Another significant advantage of the composition of the invention is that it is essentially non-foaming, even under high shear conditions.

Other components may optionally be included in the corrosion preventive composition of the invention in order to provide certain other properties which may be advantageous in particular environments. For example, lubricating properties may be imparted to the composition by the addition of a lubricating agent. It may also in such circumstances be advantageous to include a coupling agent for the purpose of maintaining the lubricating agent in solution under the various temperature conditions in which the composition of the invention might be employed.

When the composition of the invention is to be stored or shipped in closed steel containers, it has been discovered to be important to include in the composition a passavating agent in order to inhibit what was discovered to be the reaction of the alkaline phosphate with the steel drum. In the absence of the passavating agent, it was found that this reaction proceeds at an unexpectedly high rate, considering the high pH of the system, with the result that the generation of hydrogen gas is significant enough to cause a closed steel drum to bulge.

Additionally, as noted above, the inclusion of a biocide and/or a colorant in the composition of the invention may be desirable in the selected environment of use.

Accordingly, it is one object of the present invention to provide an aqueous composition for use in metal removal operations having adequate corrosion prevention properties without the need for using nitrite compounds.

Another object is to provide an effective corrosion preventive composition which eliminates the need for nitrite compounds without an increase in cost.

A further object is to provide a non-nitrite composition which exhibits corrosion preventive properties which are equal to or better than those of nitrite systems at approximately the same cost.

It is also an important object of the invention to provide a corrosion preventive composition which produces extended tool life in metal removal operations relative to standard metalworking solutions having the same lubricant components.

Yet another important object of the invention is to provide a corrosion preventive composition which is not a skin irritant.

Also an object of the present invention is to overcome the disadvantages inherent in the use of phosphonate chelating agents.

In addition, it is an object of the invention to provide an alkaline phosphate corrosion preventive composition which may safely and conveniently be stored in closed steel vessels.

A still further object of the invention is to provide a composition having not only corrosion prevention properties, but which may optionally provide lubricating properties at the temperatures ordinarily encountered in metalworking operations.

Other objects and advantages of the invention will be apparent to those skilled in the art from the following detailed description and the appended claims.

DETAILED DESCRIPTION

The composition of the invention may function effectively at any pH above 7.0; however, the preferred pH range in most metal removal operations is from about 8.0 up to about 10.0. Most preferably, the pH should be in the range of from about 9.0 up to about 9.5.

This pH range is achieved when the composition of the invention is utilized at the ordinary dilution levels employed in metalworking operations, i.e., in the general range of from about 10:1 up to about 50:1, depending on the particular application. Thus, the description which follows is of a concentrate which is ordinarily diluted prior to use.

The first component of the composition of the invention may be generally described as a salt of orthophosphoric acid. The salt may be added as the compound itself, or it may be formed in situ by the combination of phosphoric acid and the neutralizing base.

Of the general class of salts of orthophosphoric acid, the preferred compounds include alkali metal salts of orthophosphoric acid, such as monosodium phosphate and monopotassium phosphate, the amine salts of orthophosphoric acid and the alkanolamine salts of orthophosphoric acid. Of these, the most preferred compounds for use in the composition of the invention are the diethanolamine salt of orthophosphoric acid and the triethanolamine salt of orthophosphoric acid, since these amine salts are inexpensive and readily soluble in water.

It has been found that effective corrosion preventive compositions may be produced when the salt of orthophosphoric acid is present in an amount of from about 1% up to about 10% by weight of the concentrate. Preferably, however, the concentration should be in the range of from about 3.0% up to about 8.0% for most applications. The most preferred concentration range is from about 4.0% up to about 6.0% for most cutting and grinding operations.

The dibasicdioic acid component of the composition is preferably a mixture of dibasic acids which contains predominantly dodecanedioic acid. Typical products of this sort are the materials sold under the trademark Corfree TM by E. I. duPont de Nemours and Co.

As noted in the foregoing discussion, dibasicdioic acid materials, in combination with the orthophosphoric acid salts, provide unexpectedly enhanced rust protection performance in the composition of the invention at very low concentration levels. This high effectiveness at low concentrations is a distinct advantage, given the relatively high cost of such materials and their somewhat uncertain availability. A typical workable concentration range for these materials in the composition of the invention is from about 0.5% up to about 5.0% by weight, with the preferred range being from about 1.0% up to about 2.0% by weight.

In order to prevent the salting out of other components, the composition of the invention includes a chelating agent. The general types of compounds which will serve this function are well known; however, there are certain constraints on the selection of a chelater for use in a metalworking fluid. As explained in the foregoing description, it is important to avoid phosphonates since they are extremely effective in removing and suspending rust, corrosion, and fines, and the result is a metalworking fluid with an aesthetically unacceptable appearance and residue. Thus, even though such materials as nitrilo-tris(methylene phosphonic acid) are good chelating agents, they are to be avoided in the practice of the present invention.

Effective chelating agents for use in the composition of the invention include such materials as ethylenediamino-tetra-acetic acid (EDTA), the trisodium salt of N-hydroxyethyl ethylenediamino triacetic acid, gluconic acid and citric acid. Because it poses a health hazard, nitriloactic acid (NTA) is to be avoided in most metalworking environments. The best overall properties in the composition of the invention are achieved by the use of EDTA as the chelater.

In general, it has been found that effective corrosion preventive compositions should, in accordance with the invention, contain from about 0.5% up to about 6% by weight of the chelating agent in the concentrate. In most instances, the preferred concentration range is from about 1.0% up to about 5.0% by weight, though most preferably it should be in the range of from about 2.0% up to about 4.0%.

Water soluble alkaline materials which, when placed in solution with the orthophosphoric acid salt, will produce an alkaline solution are contemplated for use as neutralizing bases in the composition of the invention. Both organic and mineral salts will work, as will most amines. Alkaline earth salts, being insoluble, will not work.

Suitable materials include alkanolamines and mineral bases such as alkali metal hydroxides. Preferred bases are the alkanolamines, and among them, those which are liquids as opposed to solids, since they provide a better liquid residue at lower cost. Specific preferred materials are the di- and tri-alkanolamines, such as diethanolamine, triethanolamine, the corresponding propanolamines and the butanolamines, since the monoalkanolamines, such as monoethanolamine, are known skin irritants. In most instances, diethanolamine and triethanolamine are the most preferred materials for use in the practice of the invention, since they have the best residue and corrosion prevention characteristics at the lowest cost without being skin irritants.

A generally functional concentration range for the neutralizing base is from about 5% up to about 40% by weight of the concentrate. It has been found, however, that a concentration in the range of from about 10% up to about 30% is preferred because of the cost and corrosion prevention afforded at normal dilutions. Most preferably, the base is present in an amount of from about 20% up to about 30% by weight of the concentrate.

The composition of the invention may optionally include a water soluble lubricating agent in order to provide the composition with lubricating properties when desired. There are a great many materials which will provide lubricity to the composition of the invention and therefore enhance its performance. Among the materials which are suitable for use as lubricating agents are, by way of example only, ethoxylated esters, short chain water soluble amides, and polyethylene glycol esters, such as the stearates and laurates, having a molecular weight in the neighborhood of about 600. A particularly useful amide is diethanolamine isononanoamide, since it is resistant to degradation by bacteria.

Preferred for use in the composition of the invention are those lubricating agents which exhibit the property of so-called inverse solubility; i.e., compounds which are readily water soluble at room temperature, but are relatively insoluble at higher temperatures. Thus, the heat generated at the interface between the tool and the workpiece causes these compounds to fall out of solution precisely at the location at which lubricating properties are desired. Some commercially available compounds of this type are sold under the trademarks Inversol® (supplied by Keil Chemical Company), Ucon® (supplied by Union Carbide Corporation) and Pluronic® (supplied by BASF).

These compounds are characterized chemically by the presence of polyoxyethylene and polyoxypropylene chains that render the molecule inversely soluble in water, which make them particularly suitable for use in the compositions of the invention. Of these, the most preferred lubricants are block copolymers such as 80% polyoxypropylene, 20% polyoxyethylene and 60% polyoxypropylene, 40% polyoxyethylene.

In general, it has been found that effective lubricating properties may be obtained when the lubricating agent is present in an amount of from about 1% up to about 10% by weight of the concentrate, though a preferred concentration range is from about 2% up to about 7%. In most applications, the most preferred range is from about 3% up to about 5%.

When the composition of the invention is to be shipped or stored in contact with ferrous metals, such as when it is packaged in closed steel drums, the addition of a passavating agent is of some considerable importance for the reasons above stated. Any compatible material which will inhibit the surface reaction between the alkaline orthophosphate and the steel may be used. Some materials which have been found to be effective are peroxygenate compounds having the general formula $$M_x(M'O_y)_z$$

wherein M is a Group IA metal, M' is a Group VIB metal or boron, and x, y and z are integers of such value as is required to form an electrically neutral compound. Examples of such compounds include sodium tetraborate, sodium perchromate, and sodium permolybdate, and, of these, sodium tetraborate is preferred. Compounds such as Group IA metal nitrates and nitrites are effective inhibitors, but their use is inconsistent with one of the general objects of this invention; namely, to obtain a nitrite-free corrosion preventive composition.

In general, it has been found that effective inhibition of the reaction between the alkaline orthophosphate and the steel may be obtained when the passavating agent is present in an amount of from about 0.2% up to about 2.0% by weight of the concentrate.

In order to provide adequate protection from the fungal and microbial growth which occurs in certain environments in which the composition of the invention might advantageously be used, it has been found desirable to include in the concentrate from about 0.3% up to about 3.0% by weight of a biocide. In most circumstances, it is preferred that the biocide be present in an amount of from about 0.5% up to about 2.0%. Most preferably, a concentration on the range of from about 1.0% up to about 2.0% should be employed, although the precise environment in which the composition is to be used will dictate the optimal concentration for that use.

Effective biocides which may be included in the composition of the invention include certain alkanolamines, such as polyethoxylated n-hexyl diethanolamine, triazine, sodium Omadine® (1-hydroxypyridine-2-thione), tris-hydroxy-methyl nitromethane, and polymeric quaternary ammonium compounds.

Of special interest are the polymeric quaternary ammonium compounds, since, in addition to their biocidal properties, these materials act to drop suspended particulate matter, such as metal fines, from the fluid composition. Most preferred are the polymeric quaternary ammonium compounds which are non-foaming. One example is poly(oxyethylene(dimethylimino)ethylene dichloride).

When a lubricating agent is included in the composition of the invention, it is frequently desirable to employ a coupling agent for the purpose of maintaining the homogeneity of the composition. In general, any water soluble surfactant, including those formed within the composition itself, as opposed to being simply added in their functional form, will perform this function. A surfactant may be formed within the composition by, for example, the addition of an organic acid, which, together with the neutralizing base, forms an emulsifier or surfactant for the lubricating agent.

Some suitable classes of compounds which perform this function are fatty acids, fatty acid soaps, fatty amides, glycol ethers and water soluble ethoxylated alcohols.

The most preferred materials useful for the formation of a surfactant in situ are short chain fatty acids, especially those having from 6 to 10 carbon atoms, since they are non-foaming, they will not readily salt out of hard water, and they are relatively inexpensive. For example, caprylic acid has been found to be particularly suitable.

In general, it has been found that effective emulsifying properties may be obtained when the coupling agent is present in an amount of from about 0.5% up to about 8.0% by weight of the concentrate. Preferably, however, the concentration should be in the range of from about 2.0% up to about 6.0%. In most applications, the best results are obtained at concentrations of from about 3.0% up to about 5.0%.

The composition of the invention may also include a colorant when, for example, it is aesthetically desired.

Ordinarily, adequate coloring of the composition may be achieved when the colorant is present in the concentrate in an amount of up to about 1% by weight, although specialized needs may require additional amounts.

The following are a few examples of compositions falling within the scope of the invention.

EXAMPLE 1

A corrosion preventive cutting and grinding fluid concentrate of the invention was made by admixing the following in the amounts indicated, all amounts being expressed as weight percentages:

| | |
|---|---|
| diethanolamine | 30.00 |
| ethylenediamino tetraacetic acid | 2.00 |
| phosphoric acid | 5.00 |
| sodium tetraborate | 0.50 |
| poly(oxyethylene (dimethylimino) ethylene dichloride) | 0.50 |
| dibasicdioic acids | 1.10 |
| colorant | 0.01 |
| water | 60.89 |

The resulting concentrate was a clear fluid having a pH of 9.7±0.2 and a specific gravity at 60° F. of 1.09±0.01.

The rust preventive qualities of the composition of Example 1 were examined by comparing its performance to that of the following phosphoric acid and phosphonate fluid, which had demonstrated excellent rust protection properties:

| | |
|---|---|
| diethanolamine | 25.000 |
| phosphonate chelater | 3.000 |
| phosphoric acid | 6.000 |
| lubricating agent | 4.000 |
| caprylic acid | 4.500 |
| amine biocide | 1.000 |
| sodium tetraborate | 0.500 |
| colorant | 0.015 |

Cast Iron Chip Test Procedure

1. Place a sheet of Whatman #1 9.0 cm filter paper in the bottom of a petri dish.
2. From a supply of cast iron chips, cut dry and free from rust, nearly flat and less than ¼" in length, weigh out 2 grams of chips and place them into the dish.
3. Pour a 4 ml portion of the fluid (at the desired dilution level) over the chips in the dish.
4. Thoroughly wet the chips by swirling the dish by hand.
5. Allow the chips to soak in the dish for approximately 5 minutes.
6. Remove the fluid with a transfer pipet.
7. Allow the chips to dry in the dish for 24 hours at room temperature.
8. Examine the chips and filter paper for rust; note whether the chips stick together or not.
9. Estimate and record the percent of the surface area of the chips which has become rusted.

Cast Iron Chip Test Results

The composition of Example 1 provided rust protection equivalent to that of the phosphoric acid and phosphonate fluid against which it was compared.

The tendency of the composition of Example 1 to suspend or deposit cast iron fines was examined by comparing its performance to that of the same phosphoric acid and phosphonate fluid used in the previous test.

Cast Iron Fine Suspension Test Procedure

1. Prepare rusted cast iron fines by allowing cast iron fines to stand in tap water for approximately 24 hours. After being allowed to rust, the fines are allowed to dry in air.
2. Dilute the fluid to be tested to a normal dilution and transfer to a covered jar.
3. Add a measured amount of the rusted cast iron fines to the fluid in the jar, cap the jar, and agitate.
4. Note the extent to which the fines are deposited or remain suspended, the relative rate at which the fines are deposited, and the color and clarity of the fluid.

Cast Iron Fine Suspension Test Results

The composition of Example 1 deposited the fines on the bottom of the jar at a significantly faster rate than did the phosphoric acid and phosphonate fluid against which it was compared. In addition, the phosphoric acid and phosphonate fluid retained some of the fines in suspension or dissolved them, as evidenced by a brown tint of the fluid long after the fines had settled. The composition of Example 1, however, remained clear, evidencing a complete deposition of the fines.

The tendency of the composition of Example 1 to foam under high shear or vigorous agitation conditions was examined by comparing its performance to that of the same phosphoric acid and phosphonate fluid used in the previous test.

Blender Foam Test Procedure

1. Measure 200 ml of the fluid to be tested (at the desired dilution level) into a glass blender jar and mark the fluid level on a piece of tape applied to the jar for that purpose.
2. Place jar on blender and mix at full speed for 5 minutes.
3. Stop blender and note height of foam immediately and note speed at which foam breaks.

Blender Foam Test Results

The composition of Example 1 produced virtually no foam. The phosphoric acid and phosphonate fluid against which it was compared exhibited a high foam height, although the foam broke quickly.

EXAMPLE 2

A corrosion preventive machining and grinding fluid concentrate of the invention was made by admixing the following in the amounts indicated, all amounts being expressed as weight percentages:

| | |
|---|---|
| diethanolamine | 30.00 |
| trisodium salt of N-hydroxyethyl-ethylene diamino triacetic acid | 4.00 |
| phosphoric acid | 5.00 |
| sodium tetraborate | 0.50 |
| poly(oxyethylene (dimethylimino) ethylene dichloride) | 0.50 |
| dibasicdioic acids | 1.10 |

-continued

| | |
|---|---|
| water | 59.40 |

This concentrate, when utilized at ordinary dilution levels, was found to provide rust protection approximately equal to that of the composition of Example 1.

EXAMPLE 3

A corrosion preventive concentrate of the invention is made by admixing the following in the amounts indicated, all amounts being expressed as weight percentages:

| | |
|---|---|
| triethanolamine | 30.00 |
| ethylenediamino tetraacetic acid | 2.00 |
| phosphoric acid | 5.00 |
| poly(oxyethylene (dimethylimino) ethylene dichloride) | 0.50 |
| sodium tetraborate | 0.50 |
| dibasicdioic acids | 1.10 |
| colorant | 0.01 |
| water | 60.89 |

The concentrate of Example 3, when utilized at ordinary dilution levels, provides slightly lower rust protection than that achieved by the composition of Example 1. From the foregoing description and examples, it is apparent that the objects of the present invention have been achieved. While only certain embodiments have been set forth, alternative embodiments and various modifications will be apparent to those skilled in the art. These and other alternatives and modifications are considered equivalents and within the spirit and scope of the present invention.

What is claimed is:

1. An aqueous alkaline metalworking fluid composition in the form of a concentrate comprising:

a salt of orthophosphoric acid;

a dibasicdioic acid in an amount of up to about 5.0% by weight of the concentrate;

a chelating agent; and, a neutralizing base, said composition being essentially free of phosphates.

2. A composition according to claim 1, wherein said salt of orthophosphoric acid is present in an amount of from about 1% up to about 10% by weight;

said dibasicdioic acid is present in an amount of from about 0.5% up to about 5.0% by weight, said chelating agent is present in an amount of from about 0.5% up to about 6.0% by weight; and, said neutralizing base is present in an amount of from about 5% up to about 40% by weight.

3. A composition according to claim 1, further comprising a lubricating agent.

4. A composition according to claim 3, further comprising a coupling agent.

5. A composition according to claim 1, further comprising a passavating agent.

6. A composition according to claim 1, further comprising a biocide.

7. A composition according to claim 1, wherein said orthophosphoric acid salt is an alkali metal salt of orthophosphoric acid, an amine salt of orthophosphoric acid or an alkanolamine salt of orthophosphoric acid.

8. A composition according to claim 7, wherein said orthophosphoric acid salt is the diethanolamine salt of orthophosphoric acid or the triethanolamine salt of orthophosphoric acid.

9. A composition according to claim 1, wherein said salt of orthophosphoric acid is present in an amount of from about 3% up to about 8% by weight.

10. A composition according to claim 8, wherein said salt of orthophosphoric acid is present in an amount of from about 4% up to about 6%.

11. A composition according to claim 1, wherein said dibasicdioic acid comprises dodecanedioic acid.

12. A composition according to claim 11, wherein said dibasicdioic acid consists essentially of dodecanedioic acid.

13. A composition according to claim 1, wherein said dibasicdioic acid is present in an amount of from about 1.0% up to about 2.0% by weight.

14. A composition according to claim 1, wherein said chelating agent is ethylenediamino-tetraacetic acid, the trisodium salt of N-hydroxyethyl ethylenediamino triacetic acid, gluconic acid or citric acid.

15. A composition according to claim 14, wherein said chelating agent is ethylenediamino-tetraacetic acid.

16. A composition according to claim 2, wherein said chelating agent is present in an amount of from about 1% up to about 5% by weight of the composition.

17. A composition according to claim 16, wherein said chelating agent is present in an amount of from about 2% up to about 4% by weight of the composition.

18. A composition according to claim 1, wherein said neutralizing base is an alkylamine, an alkanolamine, or an alkali metal hydroxide.

19. A composition according to claim 18, wherein said neutralizing base is diethanolamine, triethanolamine, dipropanolamine, tripropanolamine, dibutanolamine or tributanolamine or mixtures thereof.

20. A composition according to claim 19, wherein said neutralizing base is diethanolamine or triethanolamine.

21. A composition according to claim 2, wherein said neutralizing base is present in an amount of from about 10% up to about 30% by weight of the composition.

22. A composition according to claim 1, wherein said neutralizing base is present in an amount of from about 20% up to about 30% by weight of the composition.

23. A composition according to claim 5, wherein said passavating agent has the general formula $$M_x(M'O_y)_z$$

wherein M is a Group IA metal, M' is a Group VIB metal or boron, and x, y and z are integers of such value as is required to form an electrically neutral compound.

24. A composition according to claim 23, wherein said passavating agent is sodium tetraborate, sodium perchromate, or sodium permolybdate.

25. A composition according to claim 5, wherein said passavating agent is present in an amount of from about 0.2% up to about 2.0% by weight of the concentrate.

26. A composition according to claim 6, wherein said biocide is an alkanolamine, a polyethoxylated alkanolamine, a polymeric quaternary ammonium compound, triazine, sodium(1-hydroxy-pyridine-2-thione) or trishydroxymethyl nitromethane.

27. A composition according to claim 26, wherein said biocide is a polymeric quaternary ammonium compound.

28. A composition according to claim 27, wherein said biocide is poly(oxyethylene(dimethylimino) ethylene dichloride).

29. A composition according to claim 6, wherein said biocide is present in an amount of from about 0.3% up to about 3.0% by weight.

30. A composition according to claim 29, wherein said biocide is present in an amount of from about 0.5% up to about 2%.

31. A composition according to claim 30, wherein said biocide is present in an amount of about 1%.

32. A composition according to claim 3, wherein said lubricating agent is an ethoxylated ester, a short chain water soluble amide, a polyethylene glycol ester, or a block copolymer of polyoxyethylene and polyoxypropylene.

33. A composition according to claim 32, wherein said lubricating agent is a polyethylene glycol stearate or a polyethylene glycol laurate.

34. A composition according to claim 33, wherein said polyethylene glycol stearate or said polyethylene glycol laurate has a molecular weight of about 600.

35. A composition according to claim 32, wherein said lubricating agent is a short chain water soluble amide.

36. A composition according to claim 33, wherein said short chain water soluble amide is diethanolamine isononanoamide.

37. A composition according to claim 3, wherein said lubricating agent has inverse water solubility.

38. A composition according to claim 37, wherein said lubricating agent is a block copolymer of polyoxyethylene and polyoxypropylene.

39. A composition according to claim 38, wherein said lubricating agent is an 80% polyoxypropylene 20% polyoxyethylene block copolymer or a 60% polyoxypropylene, 40% polyoxyethylene block copolymer.

40. A composition according to claim 3, wherein said lubricating agent is present in an amount of from about 1% up to about 10% by weight.

41. A composition according to claim 40, wherein said lubricating agent is present in an amount of from about 2% up to about 7%.

42. A composition according to claim 41, wherein said lubricating agent is present in an amount of from about 3% up to about 5%.

43. A composition according to claim 4, wherein said coupling agent is a fatty acid, a fatty acid soap, a fatty amide, a glycol ether, or a water soluble ethoxylated alcohol.

44. A composition according to claim 43, wherein said coupling agent is a fatty acid having from 6 to 10 carbon atoms.

45. A composition according to claim 44, wherein said coupling agent is caprylic acid.

46. A composition according to claim 4, wherein said coupling agent is present in an amount of from about 0.5% up to about 8% by weight.

47. A composition according to claim 46, wherein said coupling agent is present in an amount of from about 2% up to about 6%.

48. A composition according to claim 47, wherein said coupling agent is present in an amount of from about 3% up to about 5%.

49. An aqueous alkaline metalworking fluid composition comprising, by weight, from about 0.03% up to about 1.0% of a salt of orthophosphoric acid;

from about 0.02% up to about to 0.2% of a dibasicdioic acid;

from about 0.03% up to about to 0.5% of a chelating agent; and, from about 0.15% up to about to 4.0% of a neutralizing base, said composition being essentially free of phosphates.

50. The composition of claim 49, further comprising from about 0.03% up to about 1.0% of a lubricating agent.

51. The composition of claim 49, further comprising from about 0.004% up to about 0.2% of a passavating agent.

52. The composition of claim 49, further comprising from about 0.015% up to about 0.8% of a coupling agent.

53. The composition of claim 49, further comprising from about 0.0099% up to about 0.3% of a biocide.

54. A method of preventing corrosion of ferrous metals during metalworking operations comprising the step of utilizing as a metalworking fluid an aqueous alkaline composition comprising a salt of orthophosphoric acid, a dibasicdioic acid in an amount of from about 0.02% up to about 0.2% by weight of the fluid, a chelating agent, and a neutralizing base, said composition being essentially free of phosphonates.

55. The method of claim 54, said composition further comprising a lubricating agent.

56. The method of claim 55, said composition further comprising a coupling agent.

57. The method of claim 54, said composition further comprising a passavating agent.

58. The method of claim 54, said composition further containing a biocide.

* * * * *